US005203417A

United States Patent [19]

Glaser

[11] Patent Number: 5,203,417

[45] Date of Patent: * Apr. 20, 1993

[54] HANDHELD IMPACT POWER TOOL

[75] Inventor: Donald J. Glaser, Emporia, Kans.

[73] Assignee: Glendo Corporation, Emporia, Kans.

[ * ] Notice: The portion of the term of this patent subsequent to Feb. 27, 2007 has been disclaimed.

[21] Appl. No.: 641,658

[22] Filed: Jan. 14, 1991

[51] Int. Cl.[5] ..... B25D 9/14

[52] U.S. Cl. ..... 173/200; 173/132

[58] Field of Search ..... 173/116, 121, 132, 200

[56] References Cited

U.S. PATENT DOCUMENTS

| | | | |
|---|---|---|---|
| 2,293,443 | 8/1942 | Mossberg | 173/132 |
| 2,833,173 | 5/1958 | Aspeek | 173/121 |
| 3,111,997 | 11/1963 | Kremrel, Jr. | 173/132 |
| 3,747,692 | 7/1973 | Davidson | 173/122 |
| 4,694,912 | 9/1987 | Glaser | 173/115 |
| 4,903,784 | 2/1990 | Glaser | 173/116 |

*Primary Examiner*—Mark Rosenbaum
*Assistant Examiner*—John M. Husar
*Attorney, Agent, or Firm*—Hovey, Williams, Timmons & Collins

[57] ABSTRACT

An impact power tool for use in supporting a tool tip for hand-working operations comprises a body presenting a bore and having first and second ends. A piston is received within the bore and is shiftable relative to the body, and an anvil is received within the bore at a first end of the body and is shiftable relative to the body along the longitudinal axis thereof. The anvil includes a recess extending in a direction substantially parallel with the axis of the bore so as to define a receptacle in the anvil adjacent the first end of the bore. A tool carrier block is provided which is shaped for receipt in the recess of the anvil and which includes a set screw for permitting attachment of the carrier block to a tool tip to be supported on the impact power tool. The carrier block is retained in the anvil by friction-fit engagement sufficient to retain the carrier block in the receptacle and to permit manual removal of the carrier block. Further, the axial position of the anvil relative to the bore is fixed by a transverse member interposed between the anvil and the body. The transverse member is rigidly supported on the anvil and is resiliently supported on the body so that the anvil is capable of limited axial movement relative to the body.

16 Claims, 3 Drawing Sheets

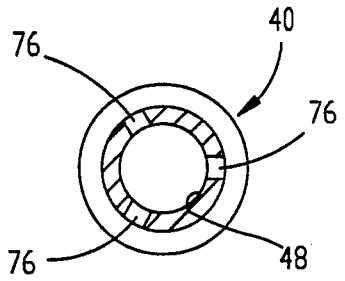
Fig. 7.
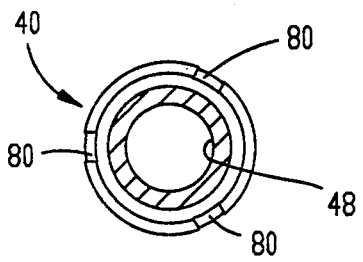
Fig. 8.
Fig. 6.
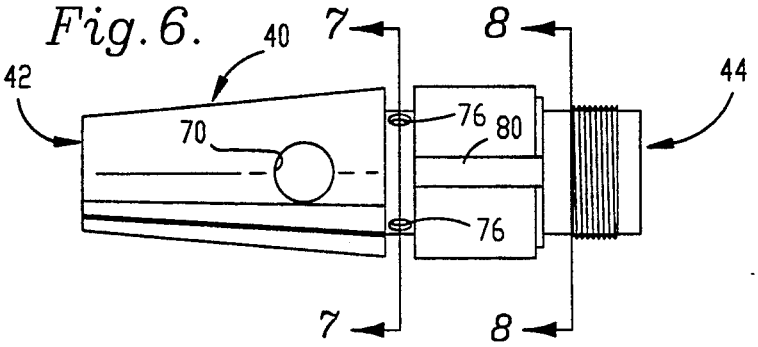
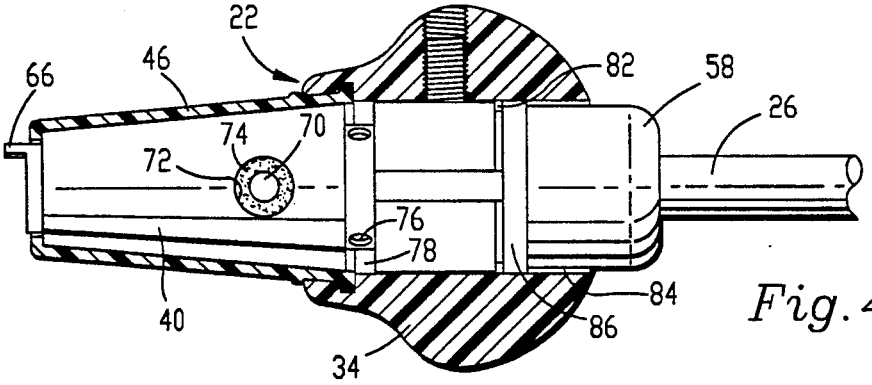
Fig. 4.
Fig. 5.
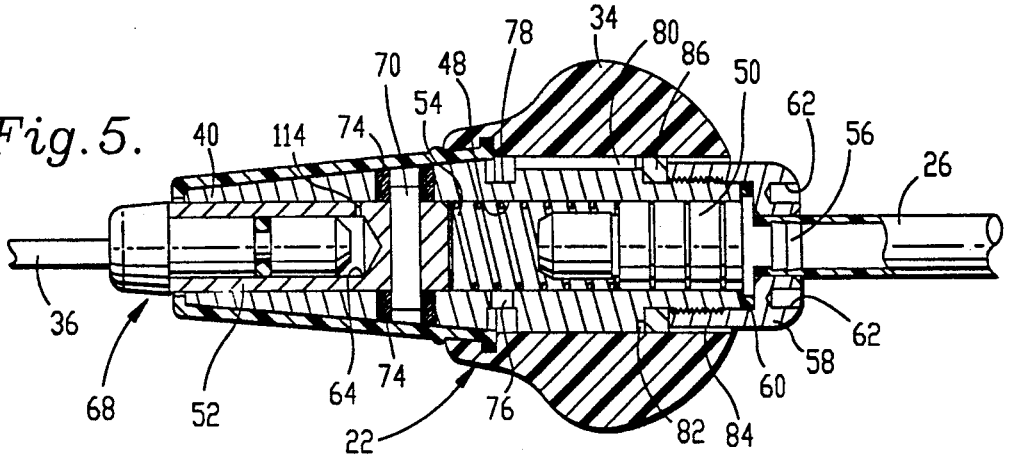

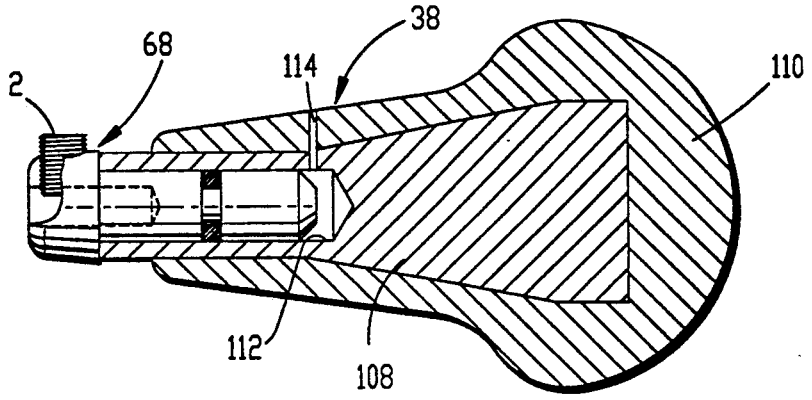
Fig. 12.
Fig. 11.
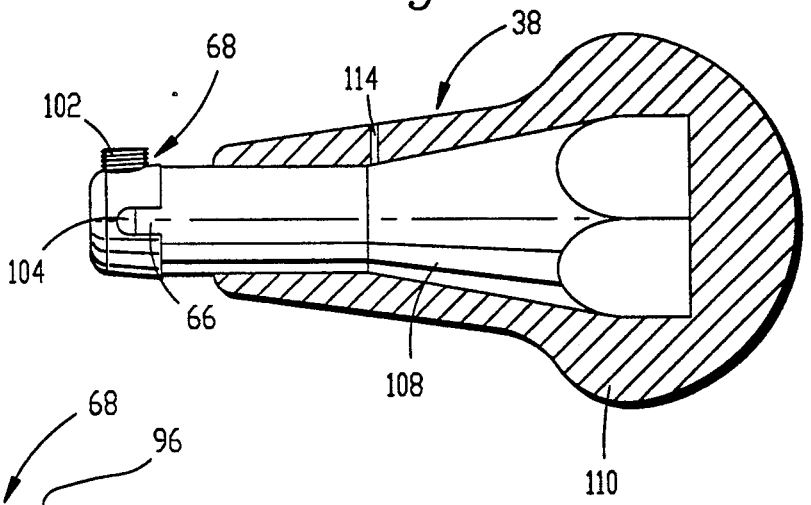
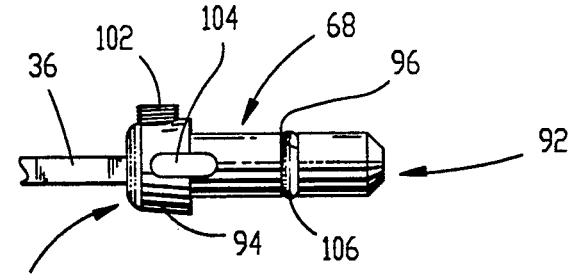
Fig. 10.
Fig. 9.
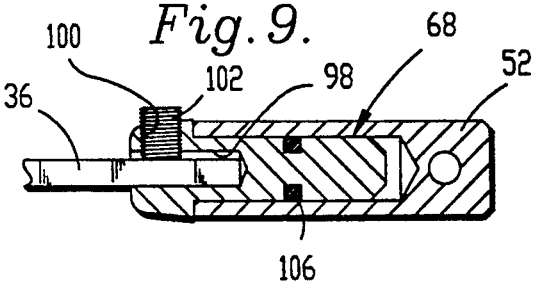

HANDHELD IMPACT POWER TOOL

BACKGROUND OF THE INVENTION

1. Field of the Invention

The present invention relates generally to impact power tools and, more particularly, to a handheld impact power tool for use in delicate hand-working operations such as those performed by a jeweler.

2. Description of the Prior Art

An impact power tool is known from U.S. Pat. No. 4,903,784, to Glaser, which may be used for engraving, carving and delicate stone setting operations.

This known power tool is adapted for use with a tool driving system of known type such as that disclosed in U.S. Pat. No. 3,393,755 to Glaser et al., and U.S. Pat. No. 4,694,912 to Glaser. A construction of the device is described in these two patents are incorporated herein by reference so as to obviate the need for further discussion of the types of devices with which the present invention may be employed.

Although the known impact power tool discussed above provides improved control of delicate hand-working operations not previously available in power tools, it would be desirable to provide a power tool which is lighter and easier to handle than known tools, and which includes a muffling system for reducing noise of the power tool which is generated during use by movement of an internal piston of the tool.

Further, although use of known power tools permits a reduction in manual effort by as much as 90% in hand-working operations relative to manually driven tools, such power tools require time consuming effort to replace the tip of the tool with an alternate tip since the tip must be secured to the tool by a threaded connection or the like. This additional required effort represents a disadvantage of known power tools since a craftsman may use as many as ten or more tips for any given job, and is thus unable to simply reach between any of a number of different tools while focusing his attention on the work at hand.

OBJECTS AND SUMMARY OF THE INVENTION

It is an object of the present invention is to provide a handheld impact power tool which overcomes the problems discussed above and which provides a simple, quiet, convenient construction and permits ready interchangeability of tips thereon. It is another object of the invention to provide a handheld manual tool and a tip carrier block which together form a complete tip handling system permitting any of a number of tips to be used in either the manual or the power tool, while enabling easy and quick replacement of the tips in either of these tools.

In accordance with these and other objects of the invention, an impact power tool is provided for use in supporting a tool tip for hand-working operations, the tool comprising a body presenting a bore and having first and second ends. A piston is received within the bore and is shiftable relative to the body, and an anvil is received within the bore at the first end of the body and is shiftable relative to the body along the longitudinal axis of the bore. The anvil includes a recess extending in a direction substantially parallel with the central longitudinal axis of the bore so as to define a receptacle in the anvil adjacent the first end of the bore. A tool carrier block shaped for receipt in the recess of the anvil includes tip attachment means for permitting attachment of the carrier block to a tool tip to be supported on the impact power tool.

The power tool also includes support means for providing friction-fit engagement between the carrier block and the anvil sufficient to retain the carrier block in the receptacle and to permit manual removal of the carrier block. Positioning means are provided for fixing the axial position of the anvil relative to the bore, the positioning means including a transverse member interposed between the anvil and the body, first support means for rigidly supporting the transverse member on one of the anvil and the body, and second support means for resiliently supporting the transverse member for limited axial movement relative to the other of the anvil and the body.

In accordance with another aspect of the invention, a carrier block for use in the abovementioned tool includes a cylindrical block body having a longitudinal axis and first and second axial ends. The block body is provided with an annular flange adjacent the first axial end of the block body, an annular groove intermediate the flange and the second axial end, an axial recess in the first end extending in a direction substantially parallel to the longitudinal axis, and a threaded transverse opening located between the annular flange and the first axial end of the body and extending between the axial recess and a region exterior of the block body. A set screw is received in the threaded transverse opening and is adapted to retain a tip relative to the block body. An o-ring formed of material which is resilient relative to the block body is received in the annular groove of the block body and is adapted to retain the carrier block in the tool by friction fit engagement between the block body and the walls of the recess of the anvil.

Finally, it is possible to provide a manual impact tool for use in supporting a tool tip. This manual impact tool is similar to the power tool in that means are provided for receiving a carrier block as described previously so as to enable interchangeability of tips between the power and manual tools.

BRIEF DESCRIPTION OF THE DRAWING FIGURES

A preferred embodiment of the invention is described in detail below with reference to the attached drawing figures, wherein:

FIG. 4 is a side elevational view, partly in section, illustrating the external surface of a body of the tool shown in FIG. 2;

FIG. 5 is a side sectional view of the tool shown in FIG. 2;

FIG. 6 is a side elevational view of the body of the tool of FIG. 2;

FIG. 7 is a cross-sectional view of the body taken along line 7—7 of FIG. 6;

FIG. 8 is a cross-sectional view of the body taken along line 8—8 of FIG. 6;

FIG. 9 is a side sectional view of a carrier block constructed in accordance with the preferred embodiment of the invention;

FIG. 10 is a side elevational view of the carrier block;

FIG. 11 is a side elevational view, partly in section, of a handheld manual tool in which the carrier block may be received; and FIG. 12 is a side sectional view of the handheld manual tool illustrating the manner in which the carrier block is received therein.

DETAILED DESCRIPTION OF THE PREFERRED EMBODIMENT

Figures 1, 2, 3:
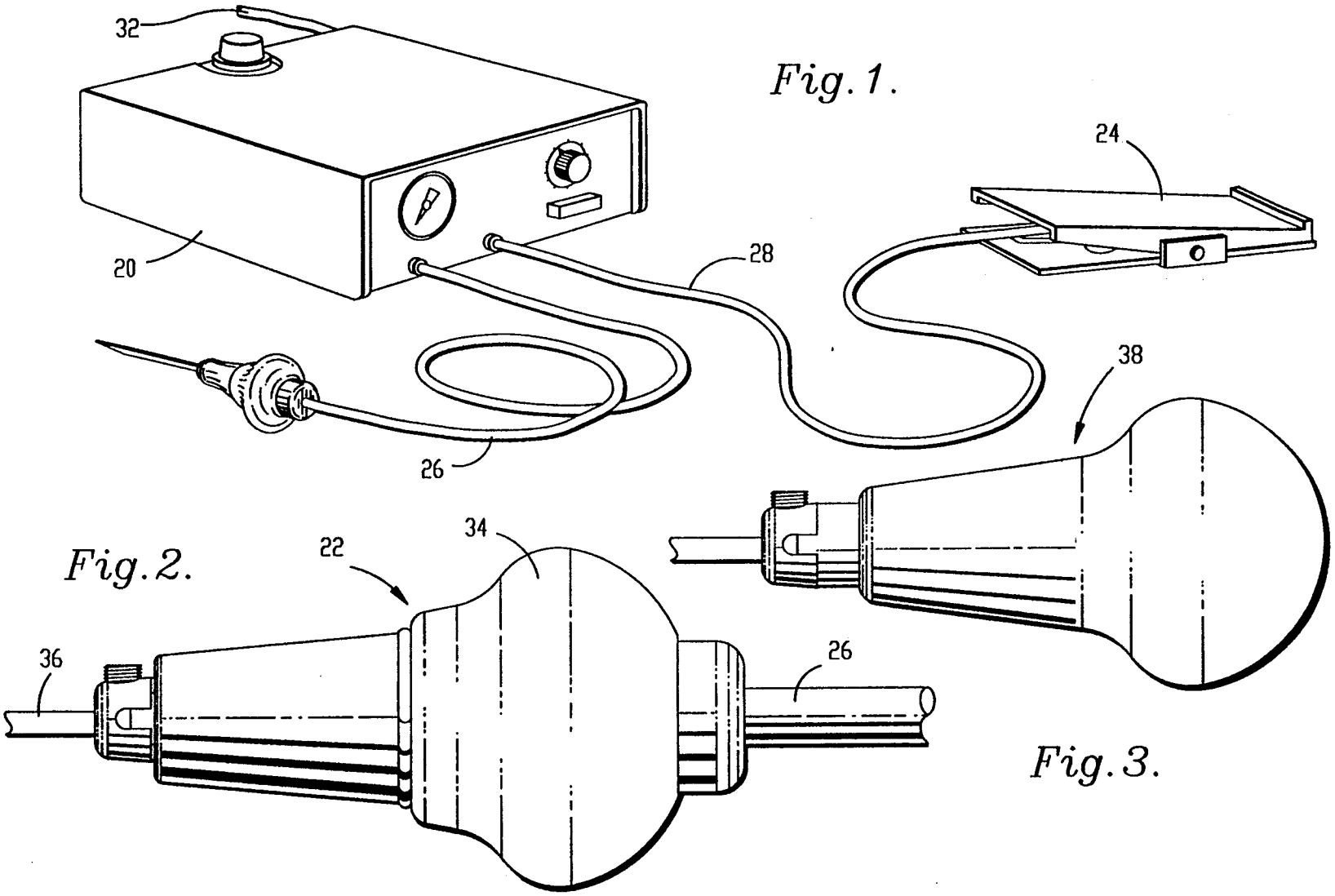
FIG. 1 is a respective view of an impact power tool system constructed in accordance with a preferred embodiment of the invention.
FIG. 2 is a side elevational view of an impact power tool forming a part of the system of FIG. 1.
FIG. 3 is a side elevational view of a manual power tool adapted for use with the system of FIG. 1.

Referring to the drawing, an impact power tool system in accordance with the invention is shown in FIG. 1 to include a control box 20, an impact power tool 22, and a foot pedal 24. The impact power tool 22 is connected to the control box 20 by a first conduit 26, and the foot pedal 24 is connected to the control box by another conduit 28. An air compressor or other source of high pressure motive fluid is connected to the control box via a conduit 32. Fluid is regulated to a suitable pressure by a regulator valve within the control box 20 as indicated by a gauge on the front panel of the control box. Thereafter, when it is desired to perform a hammering operation, the foot pedal 24 is depressed permitting a controlled amount of motive fluid to cyclically flow to and from the handheld tool 22 to actuate a hammering action therein.

The power tool 22 is shown in FIG. 2, and is formed of a user friendly shape having an external knob 34 and a tapered region extending between the knob and a tip 36 of the tool. A manual tool 38 may also be provided for use with the system of FIG. 1, and is shown in FIG. 3 to include a shape similar to the shape of the power tool 22. This manual tool 38 is described more fully below with reference to FIGS. 11 and 12.

Turning to FIG. 4, the power tool 22 is shown as including a body 40 having first and second axial ends 42, 44, the external knob 34, which is received over the body adjacent the second end thereof, and a cover or sleeve 46 extending over the surface of the body between the external knob and the first end of the body.

The body 40 includes a central bore 48, as shown in FIG. 5, which extends between the first and second ends of the body and which defines a central longitudinal axis. A piston 50 is provided which is sized for receipt within the bore 48 and which is shiftable relative to the body along the longitudinal axis between a first position as shown in FIG. 5, adjacent the second end of the body and a second position in contact with an anvil 52 provided within the bore adjacent the first end of the body. A compression spring 54 is disposed between the piston 50 and the anvil 52 for biasing the piston toward the first position out of contact with the anvil. The first conduit 26 is connected to the bore 48 by a conduit retainer 56 and is adapted to deliver motive fluid to the bore so as to drive the piston into contact with the anvil. A cap 58 is secured to the body over the conduit retainer and holds the first conduit on the tool while sealing the second end of the bore from leakage. A rubber O-ring 60 within the cap assists in preventing such leakage and a pair of opposed pin holes 62 are provided in the cap for enabling assembly and disassembly of the tool.

The anvil 52, which is also shiftable relative to the body 40, includes a recess 64 on an end thereof remote from the piston and adjacent the first end of the body, the recess defining a receptacle in the anvil. A key 66 is formed adjacent the open end of the recess 64 and serves to position a carrier block 68 relative to the anvil 52 when the carrier block is fitted in the recess. Positioning means are provided for fixing the axial position of the anvil relative to the body, the positioning means including a transverse member 70 interposed between the anvil and the body. Further, means are provided for rigidly supporting the transverse member on one of the anvil and the body, and for resiliently supporting the transverse member for limited axial movement relative to the other of the anvil and the body.

Preferably, the transverse member 70 is a cylindrical pin which is rigidly supported on the anvil 52 and which protrudes in either direction into circular holes 72 formed in the body 40 and extending radially outward from the bore 48. O-rings 74 formed of a material, such as rubber, which is resilient relative to the material of the pin are interposed between the pin ends and the body within the holes 72 in order to provide resilient support to the anvil so that the anvil is capable of limited axial and rotational movement relative to the body.

A plurality of radially extending orifices 76 are provided in the body 40 intermediate the anvil 52 and the piston 50 and serve the function of permitting air to move between the bore and a region exterior of the tool during movement of the piston. These bores are shown in FIG. 7, and open on the exterior surface of the body to an annular groove 78 which defines a space between the body and the external knob 34. As illustrated in FIG. 8, a plurality of axially extending channels 80 connect the annular groove 78 with an additional annular space 82 defined between the body 40 and cap 58 adjacent the second end of the body. This second annular space 82 communicates with a region exterior of the tool, as shown in FIG. 5, via an annular gap 84 defined between the external knob 34 and the cap 58. A muffler such as a felt O-ring 86 is disposed within the second annular space 82 for muffling the noise generated by movement of the piston within the bore.

The cover 46 is formed of a resilient material such as rubber and extends over the body between the first end thereof and the external knob 34. This cover 46 retains the O-rings 74 within the holes 72 of the body 40 and permits improved handling of the tool.

The carrier block 68, shown engaged with the anvil in FIG. 5, is shown in detail in FIG. 10, and includes a cylindrical block body having a longitudinal axis and first and second axial ends 90, 92. An annular flange 94 is formed adjacent the first axial end of the block body and an annular groove 96 extends around the body at a position intermediate the flange and the second axial end. As shown in FIG. 9, an axial recess 98 is formed in the first end 90 and extends in a direction substantially parallel to the longitudinal axis. A threaded transverse opening 100 is located between the annular flange 94 and the first axial end 90 of the body and extends between the axial recess 98 and a region exterior of the block body. A set screw 102 is received in the threaded transverse opening 100, and is adapted to retain a tip in the axial recess. An axial groove 104 is formed in the carrier block in the region of the flange and cooperates with the key 66 of the anvil 52 to retain the carrier block against rotational movement when the carrier block is in position in the receptacle. An O-ring 106 formed of material which is resilient relative to the block body is received in the annular groove 96 of the block body. The O-ring 106 is sized to provide frictional engagement between the carrier block and the anvil when the carrier block is inserted in the recess, and the frictional force exerted by the O-ring is sufficient to retain the carrier block in the receptacle during operation of the tool. However, the frictional force is not so great as to prevent simple, one-step, manual removal of the carrier block.

The manual tool 38 is shown in FIG. 11 to include an insert 108 and an external knob 110 formed around the insert. The knob is of a shape corresponding to the shape of the knob of the power tool so that the manual tool has the same look and feel as the power tool. As shown in FIG. 12, the insert 108 includes a recess 112 identical in size and shape to the recess 64 formed in the anvil 52 of the power tool 22, and is adapted to receive the carrier block 68 in the same manner. Thus, a tool tip retained in a carrier block may be positioned in either the power tool 22 or the manual tool 38 simply by inserting the carrier block into the recess of one of the tools. It is noted that an orifice 114 is provided in both the anvil and the insert to provide for air passage between the recess 64 or 112 and a region exterior of the tools so that insertion and removal of the carrier block is facilitated.

In use of the illustrated power tool, when a hammering operation is to be carried out, the tip 36 of the tool is placed in contact with the surface to be worked and motive fluid is delivered to the bore 48 of the body between the piston and the second end 44. This pressure causes the piston 50 to be forced against the action of the spring 54 toward the anvil 52. During this movement of the piston air escapes the bore 48 through orifices 76 by passing through the annular groove 78, the axial channels 80 and the felt O-ring 86 to the region exterior of the tool. The momentum of the piston 50 transfers to the anvil 52 causing the anvil to move axially relative to the body by a distance restricted by the rubber O-rings 74 interposed betweeen the pin 70 and the body, thus carrying out the hammering movement by transferring the force of the piston to the tip.

After completion of a given operation, if it is desired to change the presently mounted tip, the carrier block retaining the tip is simply pulled manually from the recess in the anvil and replaced with a carrier block supporting a different desired tip. Thus, by providing a carrier block for each different tip adapted to be used with the tool, and by securing each tip in one of these blocks, it is possible for a craftsman to use several tips interchangeably without requiring unreasonable time consumption.

Although the invention has been described with reference to the illustrated preferred embodiment, it is noted that equivalents may be employed and substitutions made herein without departing from the scope of the invention as recited in the claims. For example, although the support means of the preferred embodiment includes a resilient O-ring positioned on the carrier block, it would be possible to provide any known expedient for providing the desired friction engagement between the carrier block and the anvil so long as it is still possible to permit simple one-step insertion and/or removal of the carrier block.

What is claimed is:

1. An impact power tool for use in supporting a tool tip for hand-working operations, the tool comprising:

a body presenting a bore and having first and second ends, the bore having a central longitudinal axis;

a piston received within the bore and being shiftable relative to the body along the longitudinal axis;

an anvil received within the bore at the first end of the body and being shiftable relative to the body along the longitudinal axis of the bore, the anvil including a recess extending in a direction substantially parallel with the central longitudinal axis of the bore so as to define a receptacle in the anvil adjacent the first end of the bore;

a tool carrier block shaped for receipt in the recess of the anvil and including tip attachment means for permitting attachment of the carrier block to a tool tip to be supported on the impact power tool;

support means for providing friction-fit engagement between the carrier block and the anvil sufficient to retain the carrier block in the receptacle and to permit manual removal of the carrier block; and positioning means for fixing the axial position of the anvil relative to the bore, the positioning means including a transverse member interposed between the anvil and the body, first support means for rigidly supporting the transverse member on one of the anvil and the body, and second support means for resiliently supporting the transverse member for limited axial movement relative to the other of the anvil and the body.

2. The impact power tool as recited in claim 1, wherein:

the body includes a first hole extending in a direction perpendicular to the central axis of the bore;

the anvil includes a second hole extending in a direction perpendicular to the central axis of the bore, one of the first and second holes having a diameter which is smaller than the diameter of the other of the first and second holes; and the positioning means includes a pin having two axial ends and a diameter substantially equal to the diameter of the one of the first and second holes having the smaller diameter, the pin extending into both the first and second holes, and a ring fitted in the other of the first and second holes and surrounding the pin, the ring being formed of a material which is resilient relative to the pin.

3. The impact power tool as recited in claim 2, wherein the second hole extends completely through the anvil and the first hole extends completely through the body, the pin extending through the second hole with the axial ends of the pin projecting into the first hole.

4. The impact power tool as recited in claim 3, wherein two rings of resilient material are provided, each being fitted around one of the axial ends of the pin.

5. The impact power tool as recited in claim 1, further comprising drive means for driving the piston along a stroke length between an impact position engaging the anvil and an extended position out of contact with the anvil, the drive means including a compression spring received in the bore between the anvil and the piston, and pressurizing means for selectively pressurizing the volume of the bore between the second end of the body and the piston.

6. The impact power tool as recited in claim 1, further comprising rotation preventing means for preventing rotation of the carrier block relative to the anvil when the carrier block is retained in the receptacle.

7. The impact power tool as recited in claim 1, wherein the carrier block includes a circumferential groove extending in a direction transverse to the central axis of the bore, the tool further comprising a friction member received in the circumferential groove and being sized to provide friction-fit engagement between the carrier block and the anvil when the carrier block is positioned in the recess.

8. The impact power tool as recited in claim 7, wherein the friction member is formed of a material which is resilient relative to the carrier block.

9. The impact power tool as recited in claim 1, wherein the tip attachment means of the carrier block includes a threaded opening in the carrier block and a set screw adapted to be received in the threaded opening.

10. The impact power tool as recited in claim 1, further comprising an external knob supported on the body for permitting gripping of the tool.

11. The impact power tool as recited in claim 1, further comprising muffling means for muffling noises generated during operation of the tool.

12. A carrier block for use in removably retaining a tool tip on a tool used in hand-working operations, the carrier block defining a central longitudinal axis, first and second opposed axial ends, and an outer surface having a first predetermined diameter adapted for receipt within a tool recess defined by the tool, the carrier block comprising;

an annular flange adjacent the first end of the block and having a second diameter larger than the first diameter for defining a stop, the flange being defined by a circumferential step formed on the outer surface of the block;

an axial recess formed in the first end of the block and extending in a direction parallel to the axis of the block, the recess being adapted to receive a tool tip;

a transverse opening located between the circumferential step and the first end of the block, and extending between the axial recess and a region exterior of the block;

a tip holding means received in the transverse opening for retaining the tool tip in the axial recess;

an annular groove intermediate the circumferential step and the second end of the block, the groove defining a third diameter smaller than the first diameter; and a retaining means for retaining the block on the tool, the retaining means including an o-ring formed of a material that is resilient relative to the block, the o-ring being received in the annular groove of the block and having an outer diameter greater than the first diameter and less than the second diameter so that the o-ring provides a friction fit with the tool to retain the block in the tool recess.

13. An impact tool for use in hand-working operations comprising:

a tool having a longitudinal axis and first and second axial ends, and including a tool recess extending axially inward from the first axial end in a direction substantially parallel with the longitudinal axis;

a carrier block defining a central axis, first and second axial ends, and an outer surface sized for receipt within the tool recess, and including an annular flange adjacent the first end of the block, the flange being defined by a circumferential step formed on the outer surface of the block, an axial recess formed in the first end of the block and extending in a direction parallel to the axis of the block, the block recess being adapted to receive a tool tip, a transverse opening located between the circumferential step and the first end of the block, and extending between the block recess and a region exterior of the block, and an annular groove intermediate the circumferential step and the second end of the block, the groove defining a third diameter smaller than the first diameter;

a tip holding means received in the transverse opening for retaining the tool tip in the axial recess;

a retaining means for retaining the block on the tool, the retaining means including an o-ring formed of a material that is resilient relative to the block, the o-ring being received in the annular groove of the block and having an outer diameter greater than the first diameter and less than the second diameter so that the o-ring provides a friction fit with the tool to retain the block in the tool recess; and rotation preventing means for preventing rotation of the tool carrier block relative to the force transmitting member when the carrier block is retained in the tool recess.

14. The impact tool as recited in claim 13, wherein the friction member is formed of a material which is resilient relative to the carrier block.

15. The impact tool as recited in claim 13, wherein the tip attachment means of the carrier block includes a threaded opening in the carrier block and a set screw adapted to be received in the threaded opening.

16. The impact tool as recited in claim 13, further comprising an external knob supported on the force transmitting member for permitting gripping of the tool.

* * * * *